United States Patent [19]

Berrange

[11] 3,966,346

[45] June 29, 1976

[54] COMPACTOR

[75] Inventor: Aubrey Ralph Berrange, Pretoria, South Africa

[73] Assignee: South African Inventions Development Corporation, Pretoria, South Africa

[22] Filed: Dec. 4, 1973

[21] Appl. No.: 421,667

[52] U.S. Cl. ..... 404/124; 404/133

[51] Int. Cl.[2] ..... E01C 19/26

[58] Field of Search ..... 404/122, 125, 126, 127, 404/124; 180/24.02

[56] References Cited

UNITED STATES PATENTS

| | | | |
|---|---|---|---|
| 2,154,720 | 4/1939 | Biles | 404/122 X |
| 2,682,153 | 6/1954 | Fink | 404/122 X |
| 2,909,106 | 10/1959 | Berrange | 404/124 |
| 2,978,967 | 4/1961 | MacDonald | 404/125 |
| 3,271,041 | 9/1966 | Acker | 404/122 X |
| 3,364,665 | 1/1968 | Vigen | 404/128 X |

*Primary Examiner*—Nile C. Byers, Jr.
*Attorney, Agent, or Firm*—Karl W. Flocks

[57] ABSTRACT

A compactor which comprises a wheeled frame including a pair of laterally spaced ground wheels and a pair of laterally spaced links pivotally mounted on the frame about a common laterally extending pivot axis. A roller of non-circular cross-sectional profile is rotatably connected to the links about a laterally extending rotational axis spaced from the pivot axis. The roller is disposed between the wheels and is movable between an operative position in which it rests on and can roll along a surface supporting the wheels, and an inoperative position in which it is raised from the said surface and supported by the frame. Elevator means is provided on the frame and engageable with the roller whereby the roller is movable between its operative and inoperative positions.

13 Claims, 7 Drawing Figures

COMPACTOR

This invention relates to a compactor. In particular it relates to a compactor suitable for compacting soils, ground or the like.

According to the invention there is provided a compactor comprising:

a wheeled frame including a pair of laterally spaced ground wheels;

a pair of laterally spaced links pivotally mounted on the frame about a common laterally extending pivot axis;

a roller of non-circular cross-sectional profile rotatably connected to the links about a laterally extending rotational axis spaced from the pivot axis, the roller being disposed between the wheels and being movable between an operative position in which it rests on and can roll along a surface supporting the wheels, and an inoperative position in which it is raised from the said surface and supported by the frame; and elevator means mounted on the frame and engageable with the roller whereby the roller is movable between its operative and inoperative positions.

The wheeled frame may be in the form of a yoke comprising a laterally extending cross-member having a central longitudinally extending tongue for connection to a vehicle and a pair of arms spaced laterally along the cross-member on opposite sides of the tongue and extending longitudinally from the cross-member in the opposite direction from the tongue, the links being mounted on the frame, the wheels being mounted respectively on the arms, and the roller being connected to the links via an axle extending between the links and defining the rotational axis of the roller. The tongue may be adapted for connection to a draught vehicle, the arms being trailing arms, the links being trailing links, and the wheels being mounted on the arms about a common lateral axis spaced from the cross-member.

The elevator means may comprise a pair of telescopically extensible piston and cylinder assemblies operable by a fluid under pressure, and connected in parallel to a common fluid supply for simultaneous operation, the fluid supply being mounted on the frame, the frame being hollow and each assembly being located in the interior of the frame. The compactor may include a pair of levers respectively pivotally connected to the assemblies about a common lateral axis and pivotally anchored on the frame about a common lateral axis, the levers being pivotable about their connection to the frame in response to changes in length of the assemblies, between operative positions in which they hold the roller in its inoperative position, and inoperative positions in which they are free of the roller.

The arms may be hollow, the assemblies each being located in one of the arms, the levers being pivotally anchored respectively on the arms and having operative positions in which they abut upwardly against the axle of the roller, and the links being mounted on the arms. The levers may each have a seat for abutting upwardly against the axle of the roller, the seat, the connection to the arm and the connection to the assembly of each lever being in spaced triangular relationship, the connection to the arm being vertically spaced above the connection to the assembly and each assembly being located within the arm such that the seat projects rearwardly outwardly from the arm to a position under the axle of the roller, to permit the assembly to operate within the confines of the arm and along its length, while acting on the axle of the roller via the lever in a vertical direction.

Instead, the cross-member may be hollow, the assemblies being located in the cross-member respectively adjacent the arms, the levers being pivotally anchored on the cross-member and having operative positions in which they abut rearwardly against downward projections from the links, the links being mounted on the cross-member. The levers each may have a seat for abutting against the links, the links each having shock absorbing means for the seats to abut against, the connection between each lever and the cross-member being spaced vertically above the connection of the lever to its assembly, and each assembly being located forwardly of its lever to permit the lever to operate within the confines of the cross-member while acting rearwardly on the corresponding link.

The connections between the levers and frame may have pivot axes which are coaxial with the pivot axis of the connections between the links and the frame.

The fluid supply may include an accumulator for the storage of fluid under pressure, mounted on the frame and connected to the assemblies and to a supply line. The accumulator may comprise a casing having its interior divided by a collapsible diaphragm into a sealed gas-containing compartment and a hydraulic fluid compartment, the hydraulic fluid compartment being connected to the assemblies and the supply line.

The compactor may include, separate from the elevator means, locking means mounted on the frame and operable to hold the roller in its inoperative position.

The invention will now be described, by way of example, with reference to the accompanying drawings, in which.

Figure 1:
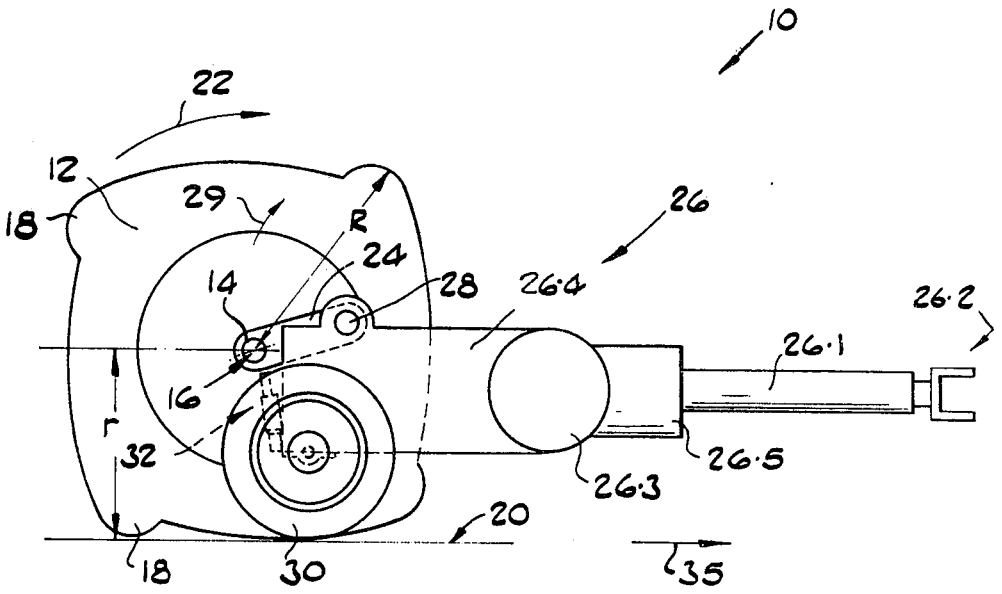
FIG. 1 shows a side elevation of a compactor in accordance with the invention.

In FIGS. 1 to 6 of the drawings, reference numeral 10 designates generally a compactor in accordance with the invention. The compactor 10 includes a roller 12 of non-circular cross-sectional profile. The roller is rotatable about a laterally extending rotational axis defined by an axle 14, the axis passing substantially through the centre of gravity 16 of the roller.

The non-circular cross-sectional profile of the roller 12 is provided by four rounded lobes 18, which cause the centre of gravity 16 of the roller to rise and fall a distance of R-r when the roller is drawn in rolling fashion over a surface 20 supporting the compactor. In rolling, the roller rotates about the axle 14 in the direction of arrow 22. After each fall of the centre of gravity 16, the roller 12 delivers an impact to the surface 20, thereby causing compaction of the material underlying the surface. Four impacts are delivered for each revolution of the roller 12, one for each lobe 18.

The opposite ends of the axle 14 are connected via a pair of trailing links 24 to a wheeled frame, generally designated by reference numeral 26. The links 24 are laterally spaced and are pivotally mounted on the frame about a common laterally extending pivot axis defined by pins 28 mounted on the frame, the axis of the pins 28 being parallel to and spaced from the axis of the axle 14.

The frame 26 is in the form of a yoke comprising a tongue 26.1 adapted by means of a connecting means in the form of a hitch 26.2 at its free end for connection to a draught vehicle. The frame 26 also comprises a laterally extending cross-member 26.3 and a pair of trailing side members or arms 26.4. The rear end of the tongue 26.1 is connected to a central projection 26.5 projecting forwardy from the cross-member 26.3, and the arms 26.4 are spaced laterally along the cross-member 26.3 on opposite sides of the tongue 26.1. The arms extend rearwardly from the cross-member 26.3 in the opposite direction from the tongue 26.1. The tongue 26.1, cross-member 26.3 and the arms 26.4 are of hollow steel box-like construction.

The frame 26 is supported by laterally spaced ground wheels 30 mounted about a common lateral axis at the rear of each side member 26.4.

Figure 6:
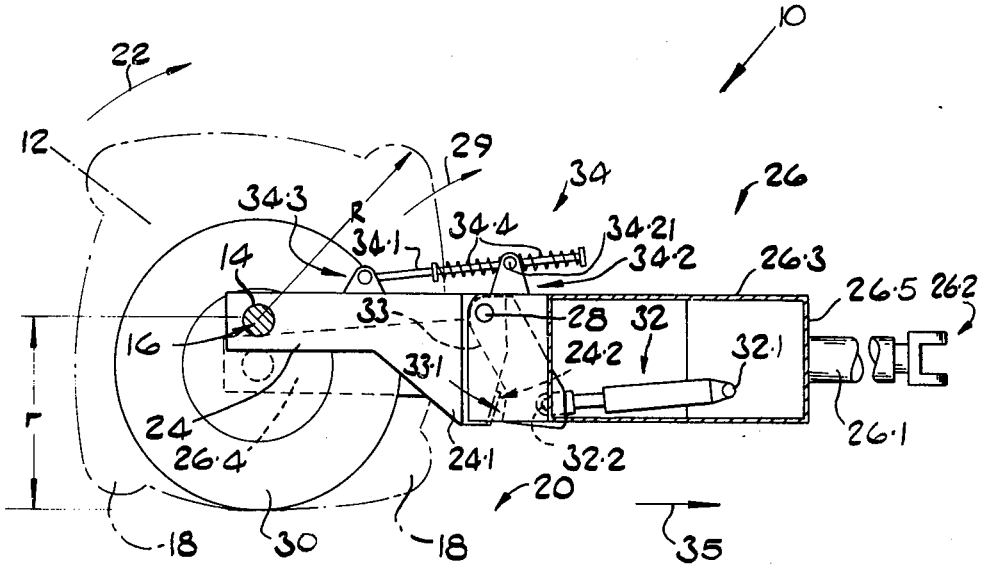
FIG. 6 shows a sectional side elevation of the compactor of FIG. 5, in the direction of line VI- VI in FIG. 5.

In FIGS. 1 to 4 a pair of wheels is shown mounted on each arm 26.4, on opposite sides thereof; and the pins 28 are shown held in brackets on the upper edges of the arms 26.4 adjacent the rear ends thereof. In FIGS. 5 and 6 the pins 28 are shown provided at the rear edge of the cross-member 26.3 inwardly adjacent the arms 26.4; and a single wheel 30 is shown mounted on each arm 26.4 on an inwardly projecting stub axle at the rear end of the arm.

Elevator means comprising a pair of matched double acting hydraulic piston and cylinder assemblies 32 is provided for moving the roller 12 between an operative position, as shown in the drawings, in which it rests on and can roll along the surface 20; and an inoperative position in which it is raised from said surface 20 and is supported by the frame 26. The assemblies 32 are telescopically extensible and are connected in parallel to a common fluid supply for simultaneous operation, as described hereunder in more detail with reference to FIG. 7.

Figure 2:
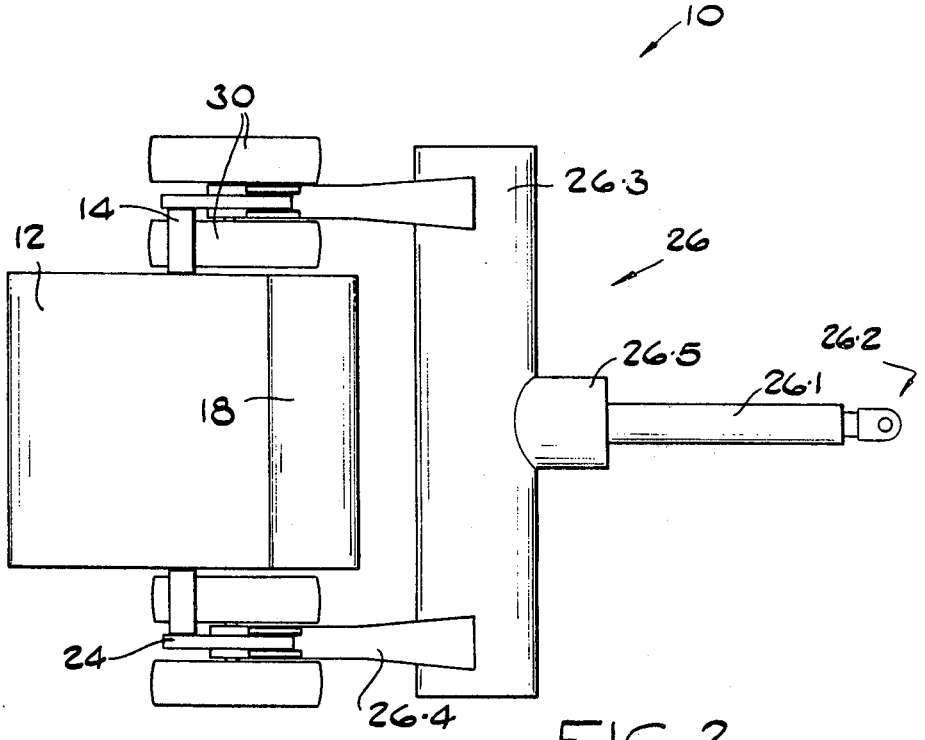
FIG. 2 shows a plan view of the compactor of FIG. 1.

In FIGS. 1 and 2 each assembly 32 has one end connected to the bottom rear of one of the arms 26.4, and its opposite end directed upwardly at and located under one of the links 24 adjacent the axle 14. When the assemblies are extended their said opposite ends act as bearing formations via which they bear upwardy against the links 24, thereby to raise the roller 12 from the surface 20. When they are retracted, the assemblies have their said opposite ends spaced downwardly from, and out of contact with, said links 24.

Figure 3:
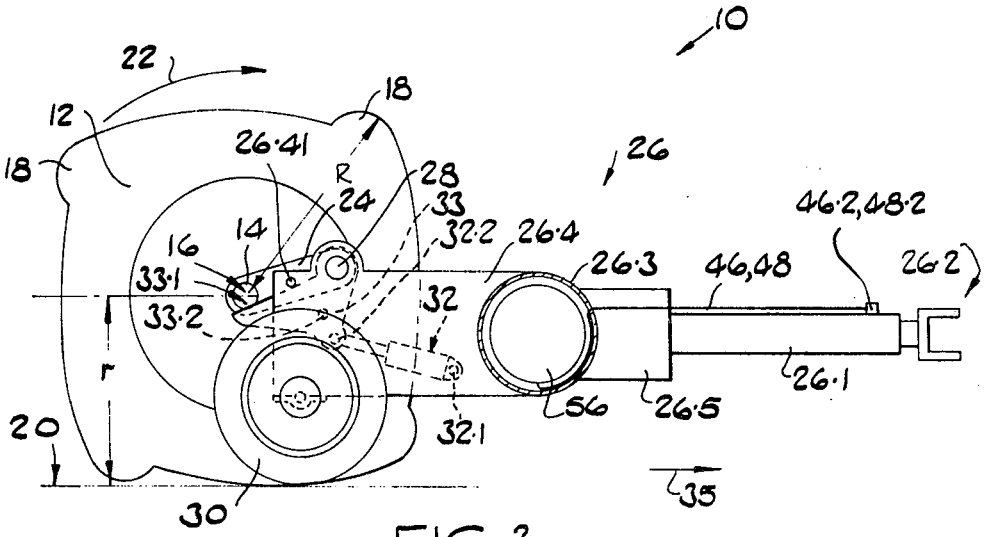
FIG. 3 shows a side elevation of another compactor in accordance with the invention.
Figure 4:
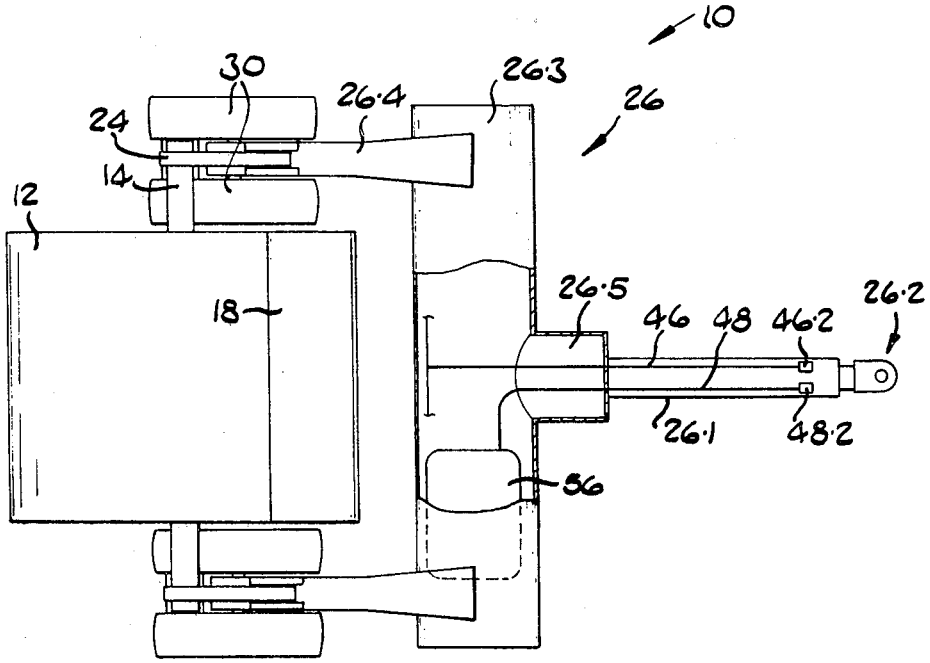
FIG. 4 shows a plan view of the compactor of FIG. 3.
Figure 5:
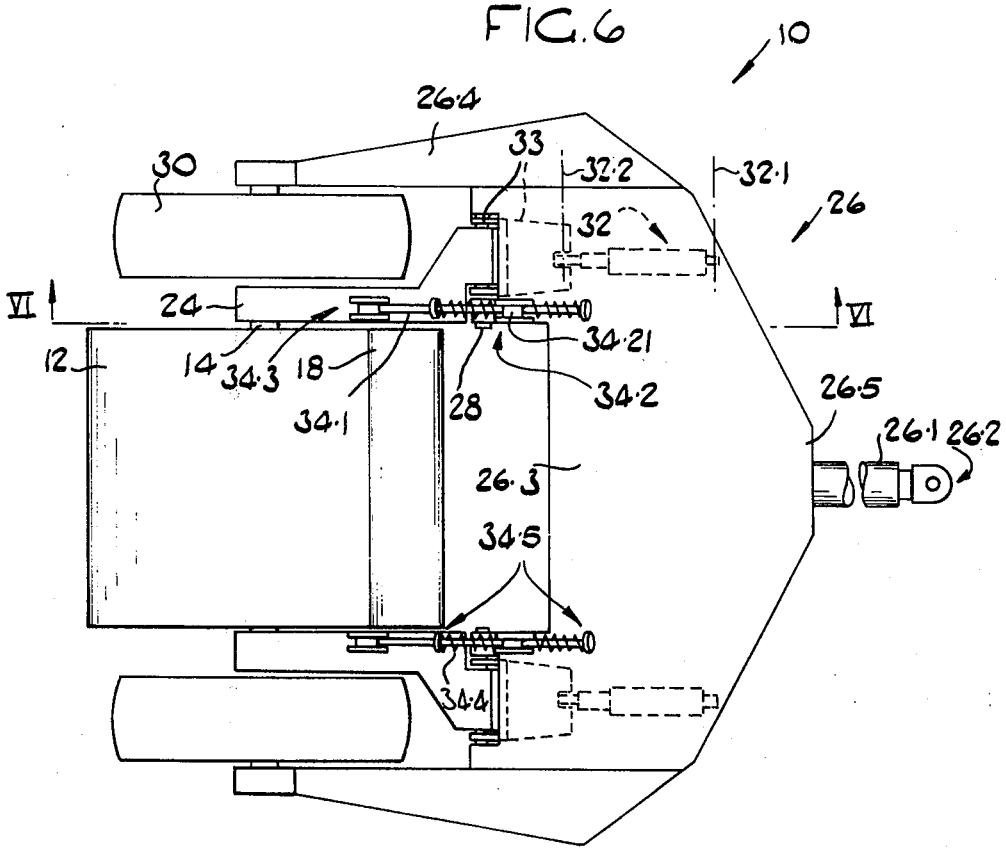
FIG. 5 shows a plan view of yet another compactor in accordance with the invention.

In FIGS. 3 and 4 the assemblies 32 are shown located in the arms 26.4, which are hollow. Each assembly 32 has its one end pivotally connected to the bottom front of the arm 26.4 in which it is located. The pivotal connections between the assemblies 32 and the arms 26.4 are about a common lateral axis 32.1. The assemblies 32 extend rearwardly, each within the confines of its arm 26.4, and the opposite ends of the assemblies are pivotally connected at 32.2, each to a lever 33. The levers 33 are laterally spaced and are pivotally supported by the pins 28, via which they are pivotally anchored to the frame. The levers are pivotable about the pins 28 in response to changes in length of the assemblies 32. They have seats 33.1 for abutting upwardly against the axle 14 of the roller 12, and are pivotable between operative positions in which they hold the roller 12 in its inoperative position clear of the surface 20; and inoperative positions in which they release the roller 12 and are free of the roller, being spaced downwardly therefrom to allow the roller to take up its operative position resting on the surface 20. Each lever 33 has its seat 33.1, its pin 28 and its connection at 32.2 to its assembly 32 in spaced triangular relationship. The pin 28 is vertically spaced above the connection 32.2 and the seat 33.1 projects rearwardly outwardly from the arm 26.4 to a position under the axle 14 of the roller 12. The assembly is thus capable of operating within the confines of the arm and along the length of the arm while acting on the axle of the roller in a vertical direction.

In FIGS. 5 and 6 the asemblies are shown located in the cross-member 26.3 adjacent the arms 26.4. The assemblies 32 each have one end thereof pivotally connected to the crossmember about a common lateral extending axis 32.1, and the opposite ends thereof pivotally connected to levers 33 about a common laterally extending axis 32.2. Levers 33 are shown pivotally anchored on the cross-member 26.3 about a common lateral axis defined by the pins 28. The levers 33 have rearwardly directed seats 33.1 adapted to abut against downward projections 24.1 from the links 24, which projections project downwardly so that they are located under the pins 28. Each projection 24.1 is provided with shock absorbing means, shown as resilient pad 24.2, but which may instead be a coil spring or the like, for the seats 33.1 to abut rearwardly against. The connections between the assemblies 32 and the levers 33 at 32.2 are located at positions spaced vertically below the pins 28. The extension of the assemblies 32 causes the seats 33.1 to abut against the pads 24.2, thereby raising the roller 12 from the surface 20, and, likewise, retraction of the assemblies 32 withdraws the seats 33.1 out of contact from the pads 24.2, to lower the roller 12 onto the surface 20.

In FIGS. 5 and 6 the compactor is shown with a damping mechanism, generally designated 34. The damping mechanism comprises a pair of laterally spaced rods 34.1, each extending rearwardly from a bracket 34.2 on the upper surface of the cross-member 26.3, adjacent one of the pins 28, to a bracket 34.3 substantially midway along the upper surface of the adjacent link 24. The rear end of each rod 34.1 is pivotally connected to its bracket 34.3 and the rod extends through a diametrical passage through a pin 34.21 which is pivotally mounted about a laterally extending axis in its bracket 34.2. Thus each rod 34.1 is pivotable about a lateral axis relative to the bracket 34.3; and is pivotable about a lateral axis relative to the bracket 34.2, while being longitudinally slidable relative to the bracket 34.2. Spaced on opposite sides of the bracket 34.2 for each rod 34.1 there is provided a pair of coil springs 34.4 under compression and located between the bracket 34.2 and a pair of shoulders 34.5 on the rod 34.1. During pivoting of the links 24 about the pins 28 when the roller 12 in use rolls along the surface 20, the rod 34.1 pivots about the brackets 34.2, 34.3 and slides longitudinally relative to the bracket 34.2. This causes additional compression of one of the springs 34.4, which thus serves to damp the pivoting of the links 24 about the pins 28.

In FIGS. 1 to 6, the assemblies 32 may be lockable in their extended operative positions thereby to act as locking means for retaining the roller 12 in its inoperative position. Instead, suitable separate locking means may be provided for locking the assemblies 32 or the levers 33, thereby to retain the roller 12 in its inoperative raised position. For example, with reference to FIGS. 3 and 4, the locking means may include pins engageable with holes 33.2 and 26.41 in the levers 33 and side members 26.4 respectively, when said holes are in register.

Figure 7:
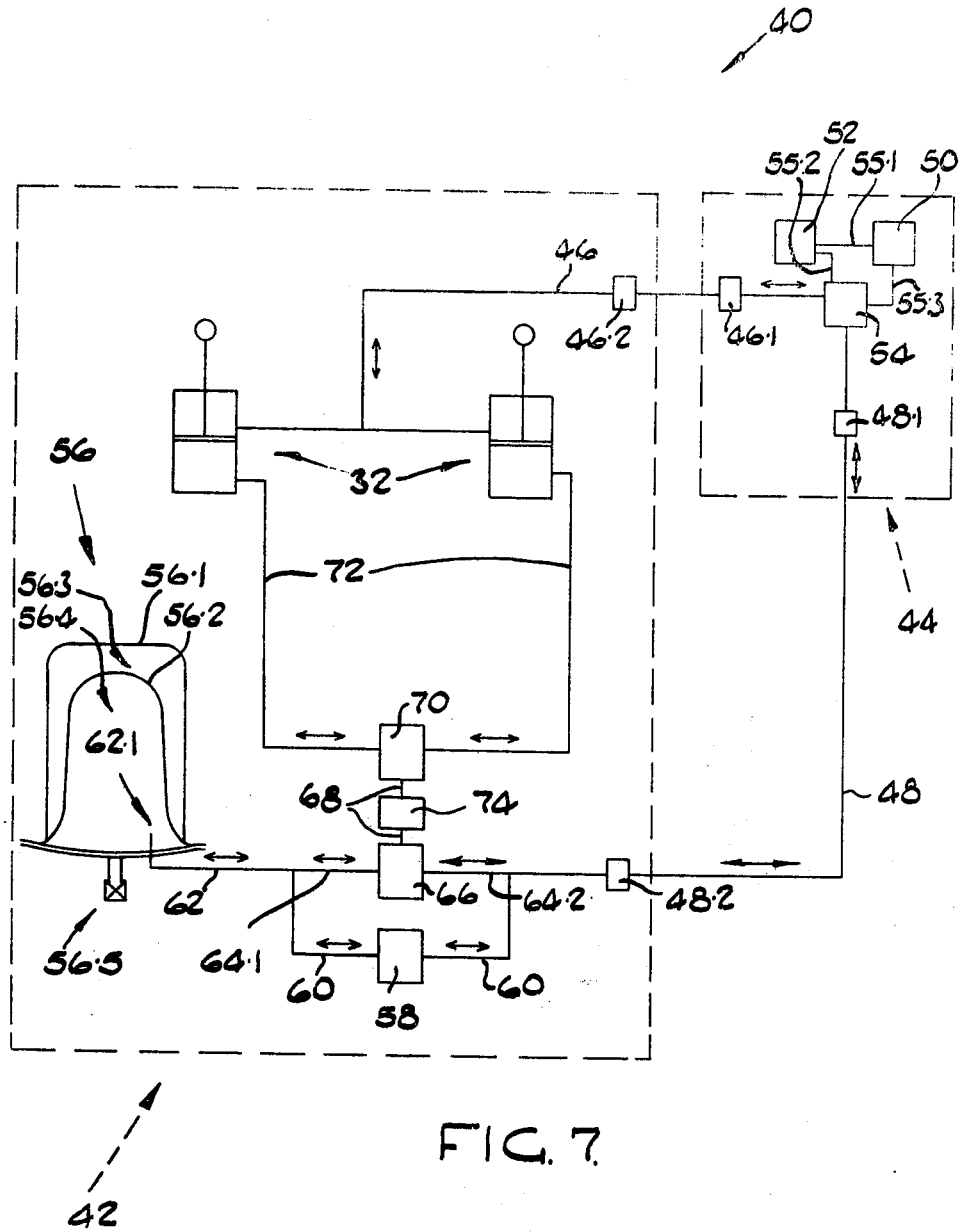
FIG. 7 shows diagrammatically a flow diagram of a hydraulic system for raising and lowering the rollers of the compactors of FIGS. 1 to 6.

Referring now to FIG. 7 of the drawings, there is shown a schematic diagram of a hydraulic system suitable for raising and lowering the roller 12 in relation to the frame 26.

Reference numeral 40 refers generally to the hydraulic system. A part of the hydraulic system, generally indicated by reference numeral 42, is mounted on and forms part of the compactor 10. Another part of the hydraulic system, which is mounted on and forms part of a draught vehicle for the compactor is generally referred to by reference numeral 44. It will be appreciated that, if desired, the entire system may be mounted on the compactor 10, and this system is contemplated when the compactor is self-propelled. The two parts 42 and 44 are interconnected via leads 46 and 48 by means of hydraulic connections 46.1 and 46.2, and hydraulic connections 48.1 and 48.2.

The hydraulic system part 44, forming part of the draught vehicle, comprises a hydraulic pump 50 fed from a reservoir 52 and adapted to deliver hydraulic fluid via a two way valve 54 operable by an operator of the draught vehicle, into either of lines 46 and 48 as desired. The pump 50 and reservoir 52 are interconnected by a flow line 55.1, and are separately connected to the valve 54 by separate flow lines 55.2 and 55.3 respectively. The valve 54 is operable so that the line 55.2 is placed in communication with the line 46 when the line 55.3 is placed in communication with the line 48; and so that the line 55.2 is placed in communication with the line 48 when the line 55.3 is placed in communication with the line 46. The valve 54 is biassed away from its said position in which the line 46 communicates with the pump 50.

The hydraulic system 40 includes an accumulator 56 for the storage of hydraulic fluid on the frame 26 (illustrated in FIG. 3 only). Delivery of hydraulic fluid takes place along line 48 when the accumulator 56 is to be charged and/or when hydraulic fluid is to be admitted to the assemblies 32 for raising the roller 12. The line 48 is connected to the accumulator 56 by branch lines 60,64 which are in parallel, and which are connected to a common line 62 which extends to the accumulator 56. The line 60 is provided with a trickle non-return charging valve 58 and the line 64 is provided with a pilot release valve 66. The pilot release valve 66 is connected via a line 68, a flow divider unit 70 and further parallel lines 72 to the assemblies 32. The flow divider unit 70 is adapted to split flow from the line 68 evenly between the lines 72. The assemblies 32 are double-acting and the lines 72 are connected to the sides of the assemblies 32 such that flow from the lines 72 into the assemblies will cause the assemblies to extend telescopically.

A valve 74 is provided in the line 68, adapted to permit unrestricted flow from the valve 66 to the flow divider 70, but to restrict reverse flow from the divider 70 to the valve 66.

In operation, the hydraulic system will be fully charged with hydraulic fluid. The roller 12 will be in its operative position rolling along the surface 20, the compactor 10 being drawn along the surface 20 by a draught vehicle (not shown). While the compactor 10 is making a pass over the surface 20 to compact the surface, or beforehand, the pump 50 is operated and the valve 54 is set so that the pump pumps hydraulic fluid via the lines 48, 60 and 62 to the accumulator 56. This pumping is at a predetermined hydraulic pressure sufficient to charge the accumulator 56, and is stopped when the accumulator is fully charged, the valve 66 being set to isolate the lines 64.1, 64.2 and 68 from one another..

At the end of a pass by the compactor 10 over the surface 20, or when otherwise desired, the pump 50 is restarted and the pilot valve is operated to place the line 64.1 in communication with the line 68. This allows the hydraulic fluid stored in the accumulator 56 to act on the assemblies 32, causing the assemblies 32 to extend to raise the roller 12 to its inoperative position. The flow dividing unit 70 ensures equal distribution of fluid to both assemblies, within a prescribed tolerance. Concurrently flow through the valve 58 from the pump 50 to the assemblies 32 ensures an adequate supply of hydraulic fluid to the assemblies to extend them to their fullest extent, and to compensate for slight leakages in the system. The accumulator 56 is used to provide a large and rapid supply of hydraulic fluid to the assemblies 32, for a fast raising of the roller. This permits a pump 50 of a relatively small size to be used.

It will be appreciated that, during extending of the assemblies 32, hydraulic fluid will be expelled from the opposite sides of the assemblies 32 along line 46 and line 55.2 to the reservoir 52.

To lower the roller 12, the valve 54 is operated to place the pump 50 in communication with the line 46; and the reservoir 52 in communication with the line 48. Fluid is thus expelled from the assemblies 32 along the lines 72, 68, 64.1 and 62 to the accumulator 56. when the accumulator 56 is fully charged, the pilot control valve 66 is operated to isolate the line 68 from the line 64.1, and to place the line 68 in communication with the line 64.2 and hence with the line 48. Flow thus takes place along the line 48 and the line 55.2 into the reservoir 52, until the assemblies 32 are fully retracted. This reverse flow along line 48 is equal to that which, in the opposite direction is required, over and above that provided by the accumulator 56, to fully extend the assemblies 32. The pilot control valve is then operated to cause it to isolate the lines 64.1, 64.2 and 68 from one another. The above described biassing of the valve 54 and the presence of the valve 74 act as safety features respectively to reduce the likelihood of inadvertant lowering of the roller 12, and to prevent excessively fast lowering of the roller.

Once the accumulator 56 has been commisioned by charging it from the pump 50, it will in use remain commissioned as it is automatically recharged whenever the roller 10 is lowered. Thus commissioning is required only at the start of a particular compacting operation.

The accumulator 56 comprises a casting 56.1 having its interior divided by collapsible diaphragm 56.2 more or less in the form of a bag, into a sealed gas-containing compartment 56.3 filled with nitrogen, and a hydraulic fluid compartment 56.4 which is in communication with the line 62. Flow of hydraulic fluid into the compartment 56.4 compresses the nitrogen in the compartment 56.3 to store energy for later expelling the hydraulic fluid to the assemblies 32. The accumulator 56 is further provided with a drain outlet 56.5 for draining and cleaning purposes. The line 62 has an inlet 62.1 into the compartment 56.4 which is elevated above the bottom of the compartment 56.4 so as to prevent clogging of the line 62 by suspended matter coming out of suspension in the hydraulic fluid in the compartment 56.4.

In using the compactor 10 for compaction the roller 12 will, as shown in the drawings, be in an operative position in contact with the surface 20, which will be that of a road, field or the like ground. The assemblies 32 will be in their retracted positions. The wheels 30 rest on the surface 20 and the compactor 10 is drawn in the direction of arrow 35 over the surface 20 by a draught vehicle (not shown) connected to the connecting means 26.2 on the tongue 26.1 of the frame 26. Movement in the direction of said arrow 35 causes the roller 12 to rotate in the direction of arrow 22, thereby compacting material underlying the surface 20, as hereinbefore described.

If it is desired to transport the compactor 10 to and from work sites where compaction is required, the roller 12 will be raised from the surface 20. The raising takes place by means of the assemblies 32 as hereinbefore described with reference to FIG. 7. In FIGS. 1 and 2 extension of the assemblies 32 causes the free ends of the assemblies to engage the links 24 and raise them and thus the roller from the surface 20. With reference to FIGS. 3 and 4, extension of the assemblies 32 causes the levers 33 to pivot about their pins 28 in the direction of arrow 29, the seats 33.1 bearing against the underside of the axle 14, thus to raise the axle and hence the roller off the surface 20. In the case of FIGS. 5 and 6, extension of the assemblies 32 causes the levers 33 to bear rearwardly via the seats 33.1 against the pads 24.2 on the downward projections 24.1 of the links 24. This likewise causes the roller 12 to be lifted off the ground.

Once the roller 12 has been lifted, pins passing through the holes 33.2, 26.41 (FIG. 3) may be used to lock the roller in its inoperative position, to relieve strain on the assemblies 32. With the roller 12 in its inoperative position, the compactor may be transported by towing it along its wheels 30 without damaging surfaces over which it passes.

When it is subsequently desired to use the compactor 10 for compaction, the assemblies 32 are activated to release the pins in the holes 33.2, 26.41 which pins are then removed. The assemblies 32 are then retracted, the links 24 and roller 12 pivoting downwardly until the roller rests on the surface 20.

The length of the links 24 and the height of the pins 28 above ground level are related to the dimensions R-r of the roller 12. The said length and height must be such as to permit the roller to be drawn in rolling fashion over the ground in its operative position, and to be supported clear of the ground in its inoperative position.

It is an advantage of the invention that the compactor is easily transportable from one site to another without the danger of breaking up roads, paved surfaces, or the like, over which the compactor may have to be transported. The quick raising of the roller obtainable by the accumulator ensures that when compaction is taking place in the vicinity of culverts, or when it is turned around at the ends of passes across surfaces being compacted, the roller may be quickly raised while the compactor is in motion and released thereafter. This quick raising and lowering ensures that the compaction can take place in close proximity to culverts and like structures or at the ends of passes where the compactor is turned around. Use of the accumulator also allows the use of a relatively small hydraulic pump on the draught vehicle.

A further important advantage of the invention is that, as the roller is connected via trailing links to the frame 26, the frame 26 does not move up and down, together with the roller 12, during compaction. Instead, the frame 26 is supported from the surface 20 by the wheels 30 at all times. This means that the frame 26 and the components of the compactor mounted thereon are not subjected to violent vibration and are less prone to suffer damage. Simple connecting means 26.2 may thus be used between the compactor 10 and its draught vehicle.

Furthermore, the fact that the wheels are located on opposite sides of the roller improves the stability of the compactor 10, particularly during movement of the compactor when the roller is in its raised, inoperative position. The wheels carry substantially the full load of the roller when the roller is raised and supported by the frame, and with the compactor in this condition the wheels can be used for edge compaction, at the edges of surfaces which cannot be reached by the roller.

I claim:

1. A compactor comprising:

a wheeled frame including a pair of laterally spaced ground wheels;

a pair of laterally spaced links pivotally mounted on the frame about a common laterally extending pivot axis;

a roller of non-circular cross-sectional profile rotatably connected to the links about a laterally extending rotational axis spaced from the pivot axis, the roller being disposed between the wheels and being movable between an operative position in which it rests on and can roll along a surface supporting the wheels, and an inoperative position in which it is raised from said surface and supported by the frame; and elevator means mounted on the frame and engageable with the roller whereby the roller is movable between its operative and inoperative positions, the operative position being such that the wheels are supported by the surface to carry the weight of the frame during rolling of the roller, the roller in its operative position being substantially freely pivotable via the links relative to the frame and carrying substantially none of the weight of the frame.

2. A compactor as claimed in claim 1, in which the wheeled frame is in the form of a yoke comprising a laterally extending cross-member having a central longitudinally extending tongue for connection to a vehicle and a pair of arms spaced laterally along the cross-member on opposite sides of the tongue and extending longitudinally from the cross-member in the opposite direction from the tongue, the links being mounted on the frame, the wheels being mounted respectively on the arms, and the roller being connected to the links via an axle extending between the links and defining the rotational axis of the roller.

3. A compactor as claimed in claim 2, in which the tongue is adapted for connection to a draught vehicle, the arms being trailing arms, the links being trailing links, and the wheels being mounted on the arms about a common lateral axis spaced from the cross-member.

4. A compactor as claimed in claim 3, in which the elevator means comprises a pair of telescopically extensible piston and cylinder assemblies operable by a fluid under pressure, and connected in parallel to a common fluid supply for simultaneous operation, the fluid supply being mounted on the frame, the frame being hollow and each assembly being located in the interior of the frame.

5. A compactor as claimed in claim 4, which includes a pair of levers respectively pivotally connected to the assemblies about a common lateral axis and pivotally anchored on the frame about a common lateral axis, the levers being pivotable about their connection to the frame in response to changes in length of the assemblies, between operative positions in which they hold the roller in its inoperative position, and inoperative positions in which they are free of the roller.

6. A compactor as claimed in claim 5, in which the arms are hollow and the assemblies are each located in one of the arms, the levers being pivotally anchored respectively on the arms and having operative positions in which they abut upwardly against the axle of the roller, the links being mounted on the arms.

7. A compactor as claimed in claim 6, in which the levers each have a seat for abutting upwardly against the axle of the roller, the seat, the connection to the arm and the connection to the assembly of each lever being in spaced triangular relationship, the connection to the arm being vertically spaced above the connection to the assembly and each assembly being located within the arm such that the seat projects rearwardly outwardly from the arm to a position under the axle of the roller, to permit the assembly to operate within the confines of the arm and along its length, while acting on the axle of the roller via the lever in a vertical direction.

8. A compactor as claimed in claim 5, in which the crossmember is hollow and the assemblies are located in the cross-member respectively adjacent the arms, the levers being pivotally anchored on the cross-member and having operative positions in which they abut rearwardly against downward projections from the links, the links being mounted on the cross-member.

9. A compactor as claimed in claim 8, in which the levers each have a seat for abutting against the links, and in which the links each have shock absorbing means for the seats to abut against, the connection between each lever and the cross-member being spaced vertically above the connection of the lever to its assembly, and each assembly being located forwardly of its lever to permit the lever to operate within the confines of the cross-member while acting rearwardly on the corresponding link.

10. A compactor as claimed in claim 5, in which the connections between the levers and frame have pivot axes which are coaxial with the pivot axis of the connections between the links and the frame.

11. A compactor as claimed in claim 4, in which the fluid supply includes an accumulator for the storage of fluid under pressure, mounted on the frame and connected to the assemblies and to a supply line.

12. A compactor as claimed in claim 11, in which the accumulator comprises a casing having its interior divided by a collapsible diaphragm into a sealed gas-containing compartment and an hydrulic fluid compartment, the hydraulic fluid compartment being connected to the assemblies and the supply line.

13. A compactor as claimed in claim 1, which includes, separate from the elevator means, locking means mounted on the frame and operable to hold the roller in its inoperative position.

* * * * *